United States Patent [19]

Ono

[11] 4,246,738

[45] Jan. 27, 1981

[54] AIR CHUCK FOR CAPPING OR UNCAPPING MACHINE

[75] Inventor: Hiroshi Ono, Kanazawa, Japan

[73] Assignee: Shibuya Kogyo Company, Ltd., Kanazawa, Japan

[21] Appl. No.: 49,937

[22] Filed: Jun. 18, 1979

[51] Int. Cl.[3] ..... B67B 3/20; B65B 7/28

[52] U.S. Cl. ..... 53/331.5

[58] Field of Search ..... 53/331.5, 367, 348, 53/353, 361, 72, 75, 76, 381 A, 317, 318, 308

[56] References Cited

U.S. PATENT DOCUMENTS

| | | | |
|---|---|---|---|
| 13,851 | 12/1914 | Brinkman | 53/348 X |
| 867,214 | 9/1907 | Schmitt | 53/353 |
| 2,705,101 | 3/1955 | Everett | 53/317 |
| 2,839,883 | 6/1958 | Roberts et al. | 53/348 |
| 3,075,331 | 1/1963 | Stanley | 53/367 X |
| 3,405,499 | 10/1968 | Dexter | 53/317 X |
| 3,491,516 | 1/1970 | Bergeron | 53/317 |
| 3,955,341 | 5/1976 | Wilhere | 53/367 X |
| 3,964,240 | 6/1976 | Evrard | 53/317 X |

*Primary Examiner*—Horace M. Culver

*Attorney, Agent, or Firm*—Blanchard, Flynn, Thiel, Boutell & Tanis

[57] ABSTRACT

An air chuck for use in a capping or uncapping machine, in which air chuck a plurality of hard members are circularly disposed and a cap receiving recess is formed in the central portion of the hard members. The hard members are so arranged as to be slid in the directions of the radii of the cap receiving recess and the sliding movement of the hard members enlarges or reduces the inner diameter of the cap receiving recess, the air chuck thereby grasping or releasing a bottle cap which is introduced into the cap receiving recess. The hard members are made of materials which are excellent in wear resistance and deterioration resistance, such as metals and synthetic resins, so as to be usable for a long period of time. The sliding movement of the hard members is effected by a driving member which is driven by compressed air.

8 Claims, 5 Drawing Figures

AIR CHUCK FOR CAPPING OR UNCAPPING MACHINE

BACKGROUND OF THE INVENTION

This invention relates to an air chuck for use in a capping or uncapping machine. More particularly, the invention relates to an improvement in an air chuck which holds a screw cap of a bottle in a capping or uncapping machine.

The capping or uncapping machine is provided with a rotary device which receives bottles from a conveyor and moves the bottles on a circular locus and air chucks which are disposed right above the received bottles. The air chucks revolve while holding bottle caps from the receiving to the releasing of bottles by the rotary device, thereby screwing caps onto bottles or unscrewing caps from bottles.

The cap holding portion of the conventional air chuck is composed of a holding member which is fitted in a chuck casing and is made of a soft elastic material and a compression disk which presses and deforms the holding member under the action of compressed air. Thus, when a bottle cap is led into the central bore of the holding member, the holding member is deformed by the pressure of the compression disk, thereby seizing the cap.

In such a prior art air chuck, however, since the holding member must be deformed by the pressure of the compression disk, the holding member must be made of a sufficiently soft elastic material so as to seize reliably a cap. As a result, wearing and deterioration of holding member occurs and the long term use of the member cannot be expected.

BRIEF SUMMARY OF THE INVENTION

It is, therefore, the primary object of the present invention to provide an air chuck for a capping or uncapping machine, which air chuck is free from the disadvantages that occur in the conventional devices.

Another object of the present invention is to provide an air chuck in which the wearing and deterioration of the holding members is minimal and, accordingly, to provide an air chuck which is durable in long term use.

In the present invention, the holding members are made of materials which are resistant to wearing or deterioration such as metals and synethetic resins. A plurality of hard members made of such material are disposed in a circle and a cap receiving recess is formed at the center of them. Further, the hard members are radially shifted by a driving member which receives the action of compressed air, thereby varying the inner diameter of the cap receiving recess and grasping or releasing a bottle cap.

A further object of the present invention is to provide an air chuck which is especially advantageous for an uncapping machine. The existence of a cap is detected by a detecting probe so as to prevent the air chuck from grasping the bottle neck without a cap. Therefore, the breaking of bottle necks and holding members can be avoided.

BRIEF DESCRIPTION OF THE DRAWINGS

These and other objects and features of the present invention will become more apparent from the following description taken in connection with the accompanying drawings, in which.

DESCRIPTION OF PREFERRED EMBODIMENT

Referring now to the accompanying drawings, the embodiment of the present invention will be described in more detail.

Figure 1:
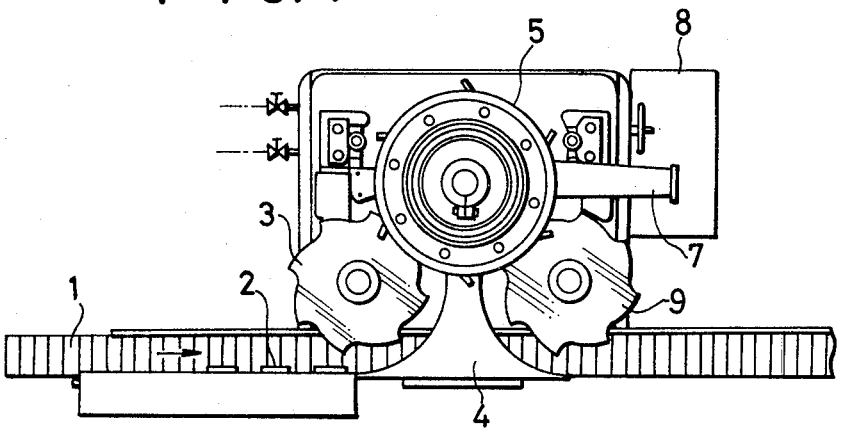
FIG. 1 is a plan view of an uncapping machine.
Figure 2:
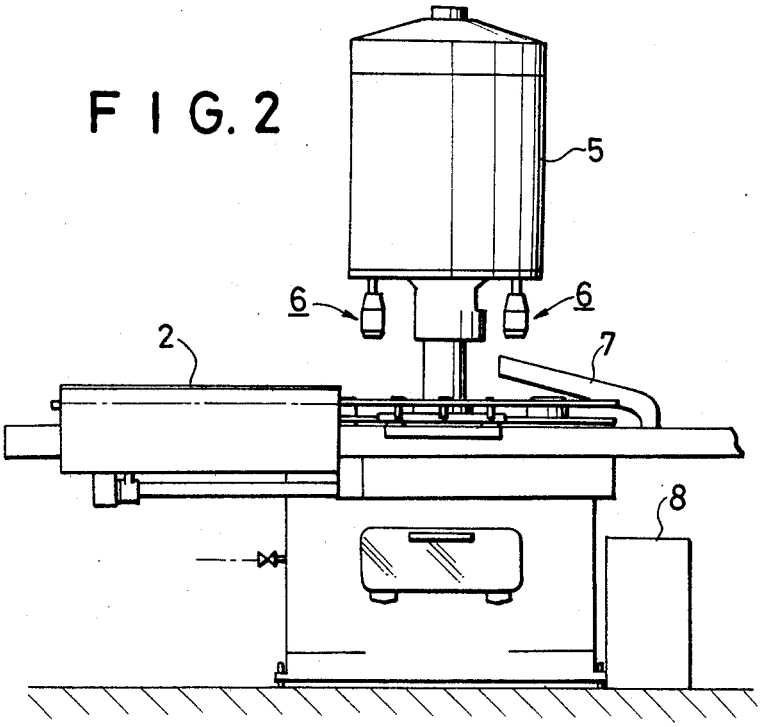
FIG. 2 is a front view of the same.

In FIGS. 1 and 2, there is shown an uncapping machine. Containers such as bottles are transferred in the direction of the arrow on a conveyor 1 and they are arranged one by one by timing screws 2. The bottles are then guided along a guide member 4 by an intake star wheel 3 and fed to a rotary table which is disposed right below a rotary device 5. Then, air chucks 6 are moved down toward the bottles on the rotary table from the rotary device 5 which rotates synchronously with the rotary table and the caps of bottles are grasped by the air chucks 6. By the revolutions of the air chucks 6, the bottle caps are unscrewed until the end of the rotation of the rotary device 5, and the unscrewed caps are then released from the air chucks 6 into a hopper 8 by way of a chute 7. Further, with the rise of the air chucks 6, the bottles are again delivered onto the conveyor 1 from the rotary table through the guide member 4 by means of the delivery star wheel 9 and are transferred to the next step.

Figure 3:
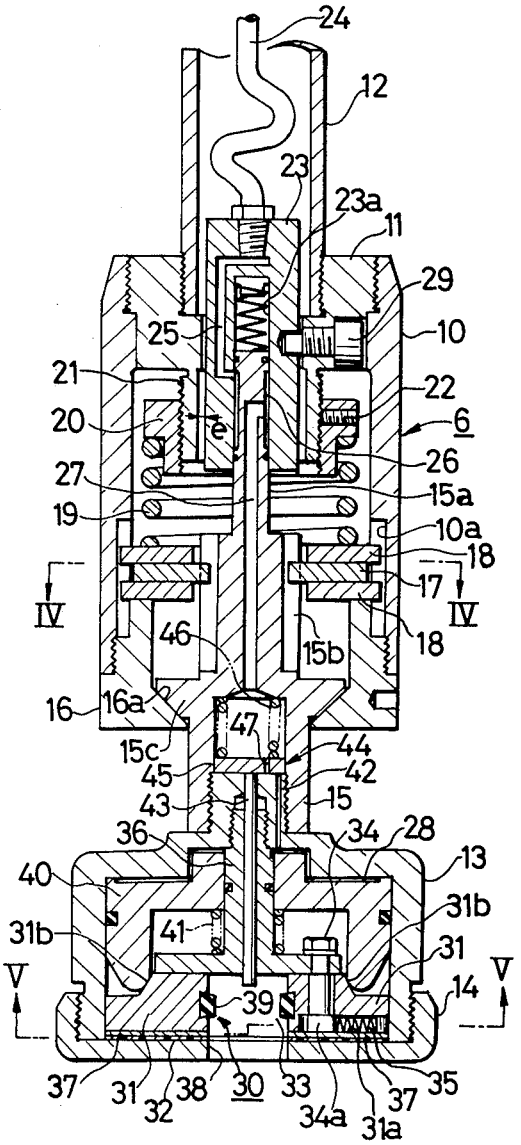
FIG. 3 is a vertical cross-sectional view of an embodiment of the air chuck of the present invention.
Figure 4:
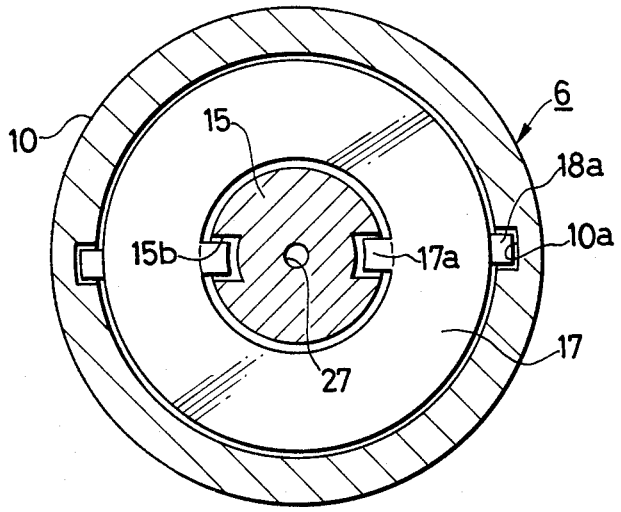
FIG. 4 is a cross-sectional view of the same taken along the line IV—IV in FIG. 3.

Further, in FIGS. 3 and 4, the air chuck 6 has an outer casing 10, the upper inner wall of which is attached by screw threads to a supporting cylinder 11. The lowermost end of an attaching tube 12 is fixed to the supporting cylinder 11. The upper end of each air chuck 6 is carried by the above-mentioned rotary device 5 and the chucks are turned and moved vertically by means of gear mechanisms and cam mechanisms (not shown in drawings) in the rotary device 5.

A chuck casing 13 has a configuration of an inverted cup and is provided with a supporting cap 14 which is fixed to the casing 13 from below with screw threads. Vertically attached to the upper end of this chuck casing 13 is a chuck guide 15 which is composed of an upper small diameter portion **15*a*, an intermediate portion having vertical grooves 15*b* (see FIG. 4) and a lower portion having an annular support 15*c*. Under the weights of the cap holding portion including the chuck casing 13 and the chuck guide 15, the annular support 15*c* is held on a spherical or conical support face 16*a* of a casing cover 16 which is screwed to the lower end of the outer casing 10. The reference numeral 17 denotes a slip washer having inner lugs 17*a* which are received in the vertical grooves 15*b* of the intermediate portion of the chuck guide 15. This slip member 17 is interposed between slip rings 18, and the lugs 18*a* of these slip rings 18 are fitted into the vertical grooves 10*a* which are formed in the inside wall of the outer casing 10. A spring 19 is disposed between the upper slip ring 18 and the flange of an adjusting nut 20. The position of the adjusting nut 20 can be fixed by a set screw 22 which is in engagement with a threaded cylinder 21 that extends downwards from the supporting cylinder 11. Accordingly, the slip washer 17 interposed between the pair of slip rings 18 is pressed to against the upper surface of the case cover 16** by the adjusted spring force of the spring 19 and the rotation applied from the side of the outer casing 10 is transmitted to the chuck guide 15 until the rotational force overcomes the predetermined friction caused on the upper and lower surfaces of the slip washer 17. Therefore, when a screw cap is attached to a bottle, the cap can be screwed and tightened to a predetermined tightness. Further, in the case of cap removing, even when a cap sticks to the neck of a bottle by some cause, the excess force of the rotation of outer casing 10 is not transmitted to the cap holding portion due to the slipping of the slip washer 17. Therefore, the cap holding portion is prevented from damaging the bottle or cap.

The smaller diameter portion 15*a* in the upper portion of the chuck guide 15 is slidably inserted into the bore 23*a* of an air supply cylinder 23 which is connected to the air passage of the rotary device 5 by means of a rotary joint (not shown) through a flexible air tube 24. The compressed air that is supplied through the air tube 24 is led into the inner passage 25 of the air supply cylinder 23 and then into the annular space 26 formed around the smaller diameter portion 15*a* which communicates with the lower end of the inner passage 25. Further, through a passage 27 which communicates with the annular space 26 and is formed on the axis of the chuck guide 15, the compressed air is supplied into an air chamber 28 that is formed in the upper portion of the chuck casing 13, which will be further described later on. The tip end of a supporting pin 29 which is screwed into the supporting cylinder 11, is loosely fitted to the air supply cylinder 23 and thus, the air supply cylinder 23 can be moved about the fulcrum of the supporting pin 29. Accordingly, the chuck guide 15 and the cap holding portion such as the chuck casing 13 that are carried below the air supply cylinder 23 can be moved to some extent. For this purpose, the clearance e is previously left between the air supply cylinder 23 and the supporting cylinder 11. Since the cap holding portion can be moved in a horizontal plane due to the fulcrum of the supporting pin 29, even when the position of a receptacle such as a bottle is irregular, the cap holding portion can be adapted to the uneven condition and the capping or uncapping operation can be attained without trouble.

Figure 5:
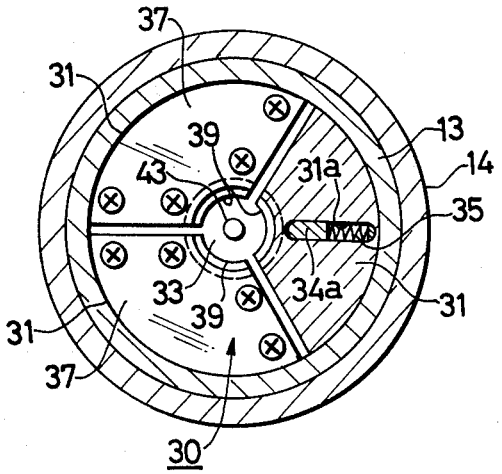
FIG. 5 is also a cross-sectional view of the same taken along the line V—V in FIG. 3.

In this embodiment, the above-described chuck casing 13 is provided with the following holding mechanism. That is, as shown in FIGS. 3 and 5, the holding member 30 is provided with equally divided three sector hard members 31 which are arranged in a circle on a Teflon sheet 32 that is held on the supporting cap 14. In the middle portion of the circle of sector hard members 31, a cap receiving recess 33 is formed. Each hard member 31 is made of a material having excellent wear resistance such as a metal or a synthetic resin. In the middle portion of the bottom surface of the hard member 31, a guide groove 31*a* is formed in the radial direction. The guide portion 34*a* that is formed at the tip end of a bolt 34 is fitted into the guide groove 31*a* and a spring 35 is set in the space between the guide portion 34*a* and one end of the guide groove 31*a*. Thus, the sector hard members 31 can be slidably moved in the directions of the radii of the cap receiving recess 33. In the ordinary state, the sector hard members 31 are radially shifted outwards by the force of the springs 35 to enlarge the diameter of the cap receiving recess 33. Thus, a cap (not shown) can be freely inserted into the recess 33. The above-mentioned bolt 34 is fixed to the lower flange of a supporting member 36 which is screwed to the chuck casing 13. Further, a plate 37 is attached to the under surface of each sector hard member 31 and an aperture 38 is formed in the supporting cap 14 so as to allow bottle caps to pass through. As shown in the drawings, an elastic member 39 made of, for example, hard rubber is fixed to the inside wall of each hard member 31, so that when the hard members 31 are shifted toward the cap receiving recess 33, the cap can be grasped reliably. It is to be noted, however, that the elastic members 39 are not necessarily required and the inner wall of each hard member 31 may be provided with a projection which is integrally made of the same material or the inner wall may be simply a plane surface.

In the space between the chuck casing 13 and the supporting member 36 is disposed a cylindrical driving member 40 which is vertically slidably and air-tightly fitted to the chuck casing 13 with a sealing member. Between this driving member 40 and the flange of the supporting member 36, a spring 41 is interposed so as to urge the driving member 40 upward. The inner wall of the driving member 40 is brought into contact with the upper inclined surfaces 31*b* of the sector hard members 31 and the aforementioned air chamber 28 is formed between the driving member 40 and the under surface of the chuck casing 13. This air chamber 28 communicates with the foregoing passage 27 through a passage 42 is formed in the chuck casing 13 and with a valve 44 which is regulated by the action of a detecting probe 43 to detect the existence of a cap. The detecting probe 43 is slidably inserted through the axis of the supporting member 36 and the chuck casing 13 and, in the ordinary state, the detecting probe 43 is urged downward by a spring 46 which is disposed in the space between the upper end flange 45 and the inner wall of the bore of the chuck guide 15, thereby protruding the lowermost end of the probe 43 to the middle portion of the cap receiving recess 33. A through hole 47 is formed in the flange 45 at the position which does not coincide with the position of the passage 42 formed in the chuck casing 13. In the state of FIG. 3 in which the flange 45 is pressed to the upper surface of the chuck casing 13 by the force of the spring 46, the communication between the through hole 47 and the passage 42 is blocked, but when the flange 45 is separated from the upper surface of the chuck casing 13 against the force of the spring 46, the through hole 47 communicates with the passage 42, thereby constituting the above-mentioned valve 44.

The working of the air chuck having the above-described structure will be explained in the following example of uncapping.

When a capped bottle is fed on the rotary table from the conveyor 1 as shown in FIGS. 1 and 2, an air chuck 6 is lowered onto the bottle neck from the rotary device 5 which is rotating synchronously with the rotary table. The cap of the bottle is received in the cap receiving recess 33 of the holding mechanism 30 through the aperture 38 of the supporting cap 14. Simultaneously with this action, the detecting probe 43 is pushed up against the force of the spring 46, thereby opening the valve 44. In this state, the air tube 24 is connected to the source of compressed air by an ordinary detecting-controlling mechanism (not shown) and the compressed air is fed into the air chamber 28 from the air source through the air tube 24, inner passage 25, annular space 26, passage 27, and the through hole 47 and inner passage 42 of the valve 44. Thus, the driving member 40 is moved down by the pressure of the compressed air in the air chamber 28. Since the inclined surfaces 31*b* of the hard members 31 are in contact with the driving member 40, the hard members 31 are shifted in an inward direction to reduce the diameter of the cap receiving recess 33, against the force of the springs 35, whereby the cap in the cap receiving recess 33 can be grasped tightly.

Rotary motion is transmitted to the attaching tube 12 of the air chuck 6 from the gear mechanisms (not shown) of the rotary device 5 and it is further transmitted to the cap holding portion such as the chuck guide 15 through the supporting cylinder 11, outer casing 10, a pair of slip rings 18 rotating together with them, and the slip washer 17 that is interposed between the slip rings 18. Therefore, the cap caught by the holding mechanism 30 is unscrewed and raised up from the bottle. Thus, the cap holding portion is also raised and the upper smaller diameter portion 15*a* is raised into the bore 23*a* of the air supply cylinder 23. In this working, when the bottle has a problem, such as the sticking of cap, the rotary motion is not transmitted to the cap holding portion because the slip washer 17 slips as described above. Further, when a bottle having no cap is inserted into the cap receiving recess 33, the detecting probe 43 is not pushed up so that the valve 44 is not opened. Accordingly, the compressed air is not introduced into the air chamber 28 and, therefore, the bottle neck is prevented from being damaged by the contact with the hard members 31.

After the above uncapping operation, when the whole body of the air chuck 6 is moved up and the supply of compressed air is stopped, the compressed air in the air chamber 28 is released and the driving member 40 is returned to the original upper position by the force of the spring 41. Simultaneously with this action, the sector hard members 31 are returned to their rest positions by the force of springs 35.

Accordingly, the diameter of the cap receiving recess 33 becomes large and the cap is released from the holding mechanism and dropped into the hopper 8 through a chute 7. After that, the uncapped bottle is transferred onto the conveyor 1 through the delivery star wheel 9 and the air chuck 6 is moved down to the neck of the next bottle, and the above-described operation is repeated. In the above paragraphs, the uncapping operation of the air chuck has been described, however, it will be apparent that the device of the present invention can also be employed in the capping operation.

Although the present invention has been described in connection with a preferred embodiment thereof, many variation and modifications will now become apparent to those skilled in the art. It is preferred, therefore, that the present invention be limited not by the specific disclosure herein but only by the appended claims.

What is claimed is:

1. An air chuck for applying or removing screw caps from bottles, comprising: an upright outer casing rotatable about a vertical axis and having an opening in its bottom coaxial with said vertical axis; an upright elongated chuck guide extending vertically through said opening and having an upper portion received within said outer casing and a lower portion extending downwardly from said outer casing; slip drive means connected between said outer casing and said upper portion of said chuck guide for normally rotating said chuck guide conjointly with said casing and permitting said outer casing to rotate relative to said chuck guide when rotation of said chuck guide is prevented; a chuck casing fixedly mounted on the lower end of said chuck guide for rotation therewith, said chuck casing having an opening in its bottom coaxial with said vertical axis and adapted for receiving the neck of a bottle therethrough, said chuck casing also having a central internal cavity therein above said opening; a plurality of sector-shaped hard members disposed in said cavity for radial sliding movement in a horizontal plane between corresponding first positions close to said vertical axis and corresponding second positions remote from said vertical axis, said hard members having arcuate radially inner surfaces which mate to define a substantially circular surface when said hard members are positioned in said first positions for engaging a bottle cap and rotating same relative to a bottle neck; a driving member disposed in said chuck casing above said hard members and means mounting said driving member for vertical sliding movement in said cavity in said chuck casing; means connecting said driving member to said hard members so that vertical movement of said driving member in said chuck casing moves said hard members between said first positions and said second positions; means defining an air cylinder for actuating said driving member; pressurized air supply conduit means extending through said upper portion of said chuck guide to said cylinder and valve means interposed between said cylinder and said pressurized air supply conduit means.

2. An air chuck as claimed in claim 1 in which said chuck casing is defined by an inverted cup-shaped housing having an upper wall and a depending side wall, said housing being closed at its bottom by a horizontal bottom wall having said opening therethrough; a supporting member coaxially disposed inside said cavity in said housing, said supporting member having a horizontal bottom wall spaced vertically upwardly from said horizontal bottom wall of said housing, said horizontal bottom wall of said supporting member being radially inwardly spaced from said side wall of said housing, said supporting member having an upright, coaxial, stem extending to and being fixed in the upper end of said housing; said sector-shaped hard members being disposed between and being in sliding engagement with said horizontal bottom wall of said housing and said horizontal bottom wall of said supporting member; said driving member being an inverted cup-shaped member having an annular top wall disposed in sliding sealed relationship on said stem of said supporting member and having a depending coaxial annular side wall disposed inside said side wall of said housing and in sliding sealed relationship therewith, said side wall of said driving member extending downwardly through the space between said side wall of said housing and said horizontal bottom wall of said supporting member, said side wall of said driving member having at the lower end thereof a vertically inclined cam surface which is in camming engagement with vertically inclined cam surfaces on said sector-shaped hard members so that downward movement of said driving member moves said sector-shaped hard members to said first positions; a first coil spring sleeved on said stem and bearing against the upper side of said horizontal wall of said supporting member and the lower side of said annular top wall of said inverted cup-shaped driving member for urging said driving member upwardly; a pressurized air supply passage extending through the upper wall of said inverted cup-shaped housing and communicating with the space between said top wall of said driving member and said upper wall of said housing.

3. An air chuck as claimed in claim 2 in which said stem of said supporting member has an upright passage therethrough; a detecting probe slidably extending through said passage to a location vertically downwardly spaced from said horizontal bottom wall of said supporting member for being moved upwardly when a bottle neck is disposed in said cavity; a valve plate mounted on the upper end of said detecting probe and extending over the upper end of said pressurized air supply passage for closing same when said probe is in its lowermost position, said valve plate having an opening therethrough laterally offset from said pressurized air supply passage so that pressurized air can be supplied to said pressurized air supply passage when said detecting probe is raised; and a second coil spring for resiliently urging said detecting probe to its lowermost position.

4. An air chuck as claimed in claim 2 or claim 3 in which each of said sector-shaped hard members has a radially extending guide groove therein, a stationary guide bolt received in said guide groove and a third coil spring acting between said guide bolt and the outer end of said groove for resiliently urging said sector-shaped hard member toward its second position.

5. An air chuck as claimed in claim 1 or claim 2 in which each of said sector-shaped hard members has a radially inwardly projecting elastic member mounted on the radially inner surface thereof for engaging a cap on a bottle.

6. An air chuck as claimed in claim 3 in which said upper portion of said chuck guide is a tubular member, an air supply cylinder mounted in said outer casing for limited pivotal movement therein about a horizontal axis, the upper end of said tubular member being vertically slidably sleeved in said air supply cylinder, a fourth coil spring resiliently urging said chuck guide downwardly relative to said air supply cylinder, means in said air supply cylinder for supplying air to the central passage of said tubular member, said central passage in said upper portion of said chuck guide having an enlarged chamber at the lower end thereof, said valve plate and said second coil spring being disposed in said chamber.

7. An air chuck as claimed in claim 1 or claim 3 in which said slip drive means comprises first disc means drivingly connected to said upper portion of said chuck guide, second disc means interleaved with said first disc means and drivingly connected to said outer casing; and a fourth coil spring for resiliently urging said first and second disc means into frictional driving engagement with each other.

8. An air chuck for applying or removing screw caps from bottles comprising a chuck casing rotatable about a vertical axis and defined by an inverted cup-shaped housing having an upper wall and a depending side wall, said housing being closed at its bottom by a horizontal bottom wall having an opening therethrough for receiving the neck of a bottle; a supporting member coaxially disposed inside the internal cavity in said housing, said supporting member having a horizontal bottom wall spaced vertically upwardly from said horizontal bottom wall of said housing, said horizontal bottom wall of said supporting member being radially inwardly spaced from the side wall of said housing, said supporting member having an upright, coaxial, stem extending to and being fixed in the upper end of said housing; a plurality of sector-shaped hard members disposed between and being in sliding engagement with said horizontal bottom wall of said housing and said horizontal bottom wall of said supporting member for radial sliding movement in a horizontal plane between corresponding first positions close to said vertical axis and corresponding second positions remote from said vertical axis, said hard members having arcuate radially inner surfaces which mate to define a substantially circular surface when said hard members are in said first positions for engaging a bottle cap and rotating same relative to a bottle; said driving member being an inverted cup-shaped member having an annular top wall disposed in sliding sealed relationship on said stem of said supporting member and a depending coaxial annular side wall disposed inside the side wall of said housing and in sliding sealed relationship therewith, said side wall of said driving member extending downwardly through the space between the side wall of said housing and said horizontal bottom wall of said supporting member, said side wall of said driving member having at the lower end thereof a vertically inclined cam surface which is in camming engagement with vertically inclined cam surfaces on said sector-shaped hard members so that downward movement of said driving member moves said sector-shaped hard members to said first positions; a coil spring sleeved on said stem and bearing against the upper side of said horizontal wall of said supporting member and the lower side of said annular top wall of said inverted cup-shaped driving member for urging said driving member upwardly; a pressurized air supply passage extending through the upper wall of said inverted cup-shaped housing and communicating with the space between the top wall of said driving member and the upper wall of said housing.

* * * * *